United States Patent [19]

Feighery

[11] 4,240,657

[45] Dec. 23, 1980

[54] LOG LIFTER

[76] Inventor: James M. Feighery, 716 Mt. Sinai Rd. South, Dalton, Ga. 30720

[21] Appl. No.: 118,844

[22] Filed: Feb. 5, 1980

[51] Int. Cl.[3] ..... A47J 49/14

[52] U.S. Cl. ..... 294/11; 294/9; 294/103 R

[58] Field of Search ..... 294/9, 10, 11, 14, 15, 294/16, 34, 50.9, 58, 103 R, 117

[56] References Cited

U.S. PATENT DOCUMENTS

| | | | |
|---|---|---|---|
| 3,032,367 | 5/1962 | Thurston | 294/103 |
| 4,186,839 | 2/1980 | Majors | 294/11 |

*Primary Examiner*—James B. Marbert

*Attorney, Agent, or Firm*—B. P. Fishburne, Jr.

[57] ABSTRACT

A unitized convenient and durable log lifter includes coaxial tube and rod members with the tube slotted longitudinally from one end to receive and guide a projecting jaw carried by the rod member which is freely movable axially of the tube throughout the length of the slot while being constrained against rotation. Coacting jaws are carried by a crosshead on the end of the tube having the slot and parallel transverse handles on the tube and rod provide easy manipulation of the device.

5 Claims, 3 Drawing Figures

LOG LIFTER

BACKGROUND OF THE INVENTION

The objective of the present invention is to provide a simple, convenient and attractive log lifter for handling fireplace logs with facility, minimum effort and safety. Various tongs and other lifting implements for this purpose are known in the prior art but these prior art devices tend to be clumsy and inefficient as in the case of simple pivoted tongs or excessively complex and costly in the case of other known devices.

Consequently, the present invention seeks to satisfy a need in the art for a truly convenient comparatively low cost log lifter which is rugged, very easy to use and which grips and transports a log in a stabilized manner with minimum physical effort.

A further object of the invention is to eliminate entirely the need for springs, screws, rivets, pins or other small parts in a device of this character. To accomplish this latter objective, the body portion or shank of the device is formed from a single section of preferably square tubing having a solid cross bar fixed to its leading end and the cross bar or head carrying a pair of spaced parallel log engaging jaws disposed equidistantly from opposite sides of the body portion or shank. The tubing section is slotted through one side wall from the cross bar rearwardly to a location on the shank which defines the limit of travel of a third log engaging jaw relative to the aforementioned pair of jaws on the cross bar. The third jaw, which is midway between the jaws in the pair, is secured to the forward end of a rod engaging coaxially and telescopically in the square tubing and having a manipulating handle at its rear end working in concert with a fixed parallel handle on the tubing between the ends of the latter. The engagement of the third jaw in the slot of the tubing prevents relative rotation between the rod and tubing. The implement cannot separate during usage and there are no small parts to become lost. No adjustments or maintenance is required.

Other features and advantages of the invention will become apparent during the course of the following description.

DETAILED DESCRIPTION

Figure 1:
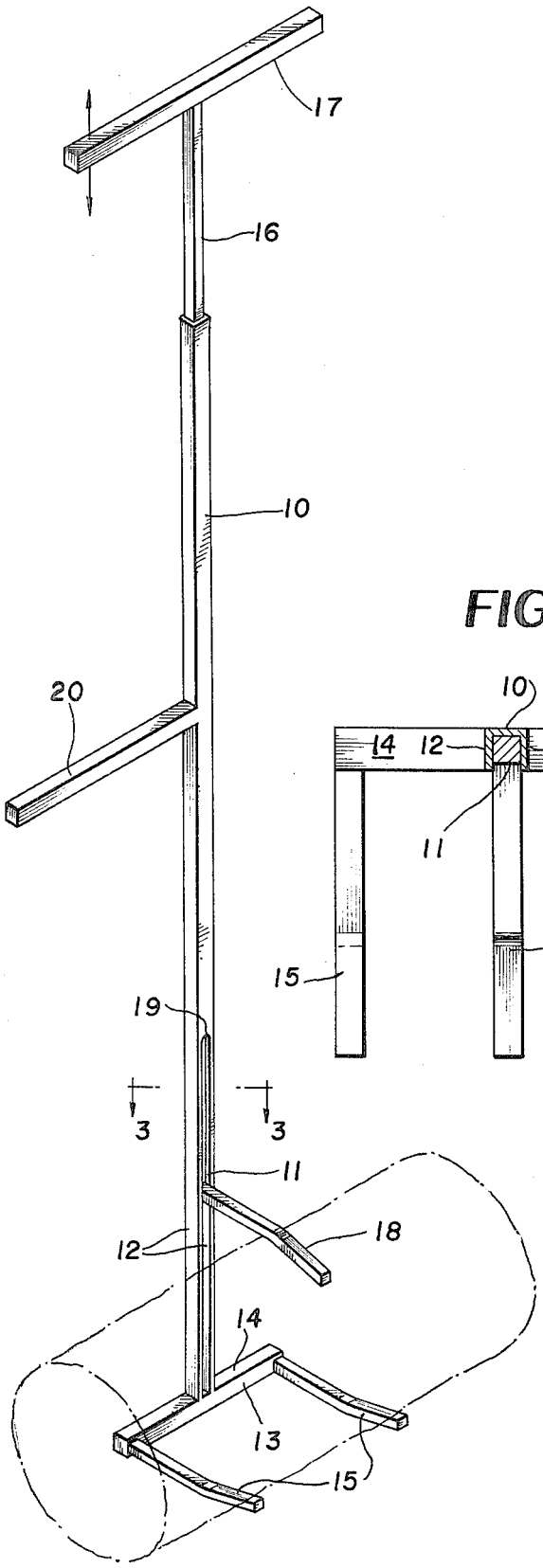
FIG. 1 is a perspective view of a log lifter according to the invention.

Referring to the drawings in detail wherein like numerals designate like parts, a fireplace log lifter comprises a main longitudinal body member in the form of a straight square cross section tube 10 open at its rear end and having a longitudinal slot 11 formed through its opposite end and through one side wall thereof, the slot 11 extending for the entire distance between the two adjacent right angular side walls 12 of the tube 10. The slot 11 extends lengthwise of the tube 10 for a substantial distance rearwardly of its leading end, such as about ten inches in a practical embodiment of the invention.

Welded across the leading end of the tube 10 is a comparatively short transverse bar or crosshead 13 extending equidistantly beyond opposite sides of the tube 10, and disposed at right angles to the tube. The crosshead 13 is preferably square in cross section and of the same dimensions as the square tube 10. One side wall 14 of the crosshead 13 forms a closure for the leading end of slot 11.

A pair of laterally spaced parallel contoured log engaging jaws 15 is fixed to opposite ends of the crosshead 13 rigidly and project forwardly from the side surface of the crosshead which is normal to the surface 14. The jaws 15 are of equal length and they are spaced apart equidistantly from the axis of the tube 10. Preferably, the jaws 15 are also formed of square cross section stock.

The log lifter further comprises a longitudinally reciprocating square cross section rod 16 having a smooth sliding fit within the square tube 10 and being provided at its rear end with a transverse operating handle 17 welded thereto and also preferably formed of square stock for uniformity of appearance. The handle 17 extends equidistantly from opposite sides of the tube 10 and rod 16 and is parallel to the crosshead 13. It cannot rotate because of the interfitting relationship of the square tube and rod.

Figure 2:
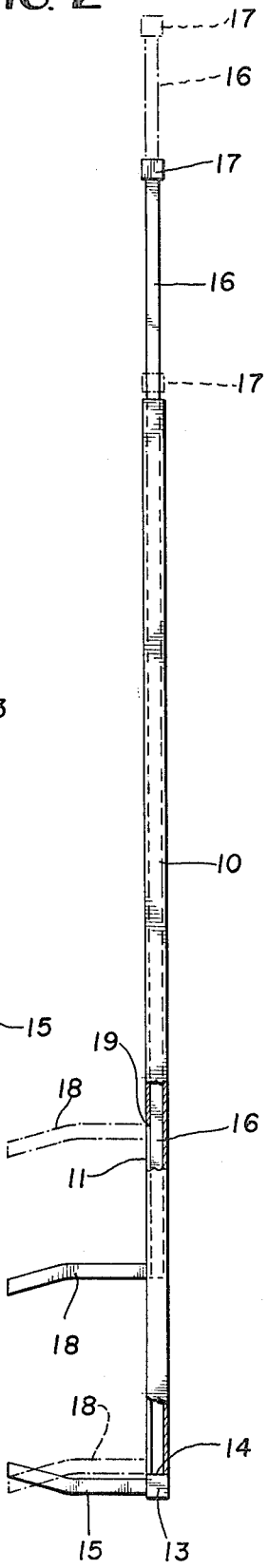
FIG. 2 is a side elevation thereof, partly broken away and partly in section.
Figure 3:
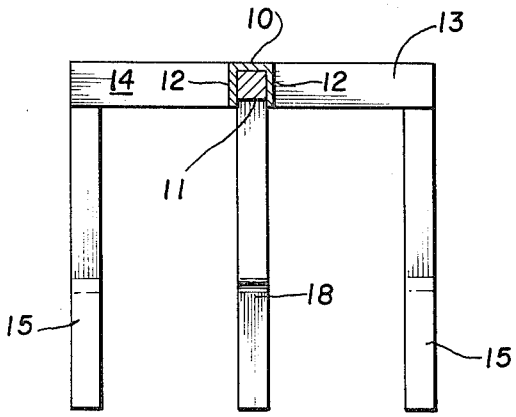
FIG. 3 is an enlarged transverse horizontal section taken on line 3—3 of FIG. 1.

At its leading end, the rod 16 carries a single contoured log engaging jaw or tine 18 midway between the two jaws 15 in opposing relationship thereto and being of the same length as the jaws 15. The jaw 18 is welded to the rod 16 and projects through the slot 11. Like the handle 17 and rod 16, the jaw 18 cannot rotate relative to the jaws 15 but is free to shift longitudinally with the rod 16 toward and away from jaws 15. FIGS. 1 and 2 show the jaw 18 in full line in an intermediate adjusted position. FIG. 2 shows the jaw 18 in broken lines at its two extreme positions toward and away from the jaws 15.

The full forward position of jaw 18 is limited by contact of the forward end of rod 16 with the surface 14 which closes the forward end of slot 11. Retraction of the jaw 18 from jaws 16 is limited by contact of the jaw 18 with the rear end 19 of slot 11.

Additionally, the lifter includes a transverse rigid handle 20 formed of square stock welded to one side of the tube 10 and projecting therefrom in parallelism with the handle 17 and crosshead or bar 13. The handle 20, in practice, can be located approximately one foot from the rearward end of tube 10 although this distance is not critical. Likewise, in practice, the tube 10 may be approximately two feet, ten inches in length, making the overall length of the lifter approximately three feet. These dimensions can be varied somewhat.

In use, the device is convenient in that logs of various sizes can be picked up and manipulated without dropping them as frequently occurs with common tongs. Relatively small effort on the part of the user is required. The provision of the two handles 17 and 20 makes linear adjustment of the jaw 18 very easy.

One of the main advantages of the device is the absence of all screws, guide pins, springs or other small parts which can separate and be lost. When the device is assembled, it is permanently assembled, very rugged and there is no way for the parts to separate or be lost or misaligned during use.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A log lifter comprising a straight tubing section which is elongated and provided with a side wall slot opening through one end of the tubing section, a transverse bar member fixed to said one end of the tubing section and extending on opposite sides thereof and closing said slot at said one end, the opposite end of the slot terminating between the ends of the tubing section, a pair of spaced log engaging jaws carried by opposite ends of said bar member and projecting beyond one side of the tubing section, a reciprocating rod engaged slidably and non-rotatably in the tubing section for movement lengthwise therein and having a rear end operating handle, a coacting operating handle on the tubing section between the opposite ends of the same, and a single log engaging jaw secured to the end of said rod adjacent to the bar member and away from the operating handle of the rod and projecting through said slot and arranged in opposed relation to and substantially midway between the jaws of said pair, said single jaw being shiftable through said slot longitudinally and the opposite closed ends of the slot limiting movement of said single jaw with said rod and rod operating handle forwardly and rearwardly relative to the tubing section, and the engagement of said single jaw in said slots maintaining the tubing section and said rod in permanently assembled non-rotational relationship.

2. A log lifter as defined in claim 1, and said rear end operating handle and coacting operating handle being parallel to each other and to the transverse bar member and lying in a common place with the transverse bar member, all of said jaws extending substantially equidistantly from said common plane in one direction.

3. A log lifter as defined in claim 1, and said straight tubing section being rectangular in cross section, said slot being formed through one side wall of the tubing section entirely between two adjacent parallel side walls thereof.

4. A log lifter as defined in claim 1, and said opposing pair of jaws and single jaw comprising rod members which are contoured longitudinally to embrace a log when moved into engagement therewith.

5. A log lifter as defined in claim 1, and said transverse bar member comprising a comparatively short bar member extending equidistantly on opposite sides of said tubing section.

* * * * *